United States Patent [19]

Omori et al.

[11] Patent Number: 4,501,250

[45] Date of Patent: Feb. 26, 1985

[54] METHOD AND APPARATUS FOR CONTROLLING AN INTERNAL COMBUSTION ENGINE

[75] Inventors: Norio Omori, Kariya; Tsutomu Tabe, Chita; Katsunori Ito, Aichi; Shuukichi Hayashi, Kariya, all of Japan

[73] Assignee: Nippondenso Co., Ltd., Kariya, Japan

[21] Appl. No.: 474,982

[22] Filed: Mar. 14, 1983

[30] Foreign Application Priority Data

Mar. 15, 1982 [JP] Japan ..... 57-41133

[51] Int. Cl.[3] ..... F02M 51/00

[52] U.S. Cl. ..... 123/486

[58] Field of Search ..... 123/416, 417, 480, 486, 123/487; 364/431.05

[56] References Cited

U.S. PATENT DOCUMENTS 4,313,412 2/1982 Hosaka et al. ..... 123/480
4,319,451 3/1982 Tajima et al. ..... 123/480
4,366,541 12/1982 Mouri et al. ..... 123/486
4,445,489 5/1984 Kobayashi et al. ..... 123/486

FOREIGN PATENT DOCUMENTS 0096132 8/1981 Japan .

*Primary Examiner*—Parshotam S. Lall
*Assistant Examiner*—W. R. Wolfe
*Attorney, Agent, or Firm*—Cushman, Darby & Cushman

[57] ABSTRACT

For controlling an internal combustion engine at least first and second control maps are provided in which first and second control variables are stored respectively, which are addressible in response to different combinations of output parameters of the engine. First and second weighting factors are derived for weighting first and second control variables which are derived respectively in response to a first and a second combination of engine output operating parameters. The weighted first and second control variables are summed to derive a combined control variable for controlling one of the input operating parameters.

17 Claims, 16 Drawing Figures

METHOD AND APPARATUS FOR CONTROLLING AN INTERNAL COMBUSTION ENGINE

BACKGROUND OF THE INVENTION

The present invention relates to a method and apparatus for controlling an internal combustion engine.

It is known in the art to store an array of engine control variables in a map of a microcomputer and address an appropriate one in response to a set of corresponding engine operating parameters. The control variable derived from the map is used to control one of a plurality of engine input variables such as air-fuel mixture, ignition timing and so on. An engine control apparatus, as shown and described in Japanese Patent Publication (Tokkaisho) No. 56-96132, comprises a pair of such engine control maps in which different set of control variables are stored. These maps are selectively addressed according to different engine operations so that in response to a transient condition the control variables are switched from one map to another with or without hysteresis. Due to the switching action, there occurs a rapid change in engine control which is likely to result in unpleasantness in driving and a deviation in air-fuel ratio from a controlled point.

SUMMARY OF THE INVENTION

It is therefore an object of the invention to provide a method and apparatus which ensures smooth transition in engine control characteristic against the occurrence of a transition in an engine output operating parameter.

The object is achieved by weighting at least two control variables derived by individual factors and summing them to derive a combined variable for controlling an input operating parameter of the engine.

According to a first aspect, the invention provides a method for controlling an internal combustion engine having a plurality of input operating parameters, a plurality of output operating parameters. At least first and second control maps are provided in which first and second control variables are arranged respectively, the first and second control variables being addressible in response to different combinations of the output parameters. The method comprises detecting first, second and third output operating parameters of the engine, and deriving first and second weighting factors. The first control map is addressed to derive a first control variable in response to the detected first and second output operating parameters, and the second control map is addressed to derive a second control variable in response to the detected second and third output operating parameters. The first and second control variables are multiplied by the first and second weighting factors, respectively, and summed to derive a combined control variable for controlling one of the input operating parameters.

Because of the weighted control variables, the input operating parameter of the engine, such as air-fuel mixture, is regulated smoothly even when the engine is rapidly accelerated or decelerated.

Preferably, the weighting factors are derived in accordance with a set of corresponding engine output parameters including throttle opening and intake manifold pressure.

In a second aspect, the invention provides an apparatus for controlling an internal combustion engine having a plurality of input operating parameters. The apparatus includes a plurality of sensors for detecting output operating parameters of the engine, and a microcomputer having at least first and second control maps in which first and second control variables are arranged respectively, the first and second control variables being addressible in response to different combinations of the detected output operating parameters, the microcomputer being programmed to execute the following steps:

(a) deriving first and second weighting factors; third output operating parameters.

(b) addressing the first control map to derive a first control variable in response to the detected first and second output operating parameters;

(c) addressing the second control map to derive a second control variable in response to the detected second and third output operating parameters;

(d) multiplying the first and second control variables by the first and second weighting factors, respectively; and (e) summing the multiplied first and second control variables to derive a combined control variable for controlling one of the input operating parameters.

BRIEF DESCRIPTION OF THE DRAWINGS

The present invention will be described in further detail with reference to the accompanying drawings, in which.

DETAILED DESCRIPTION

It is to be noted the present invention can be adapted for use in any one of various engine control systems whose operating parameters include air-fuel mixture, ignition timing, recirculated exhaust gas and engine speed. In a typical example, the ratio of air-fuel mixture is used in the present invention as a representative of such parameters.

Figure 1:
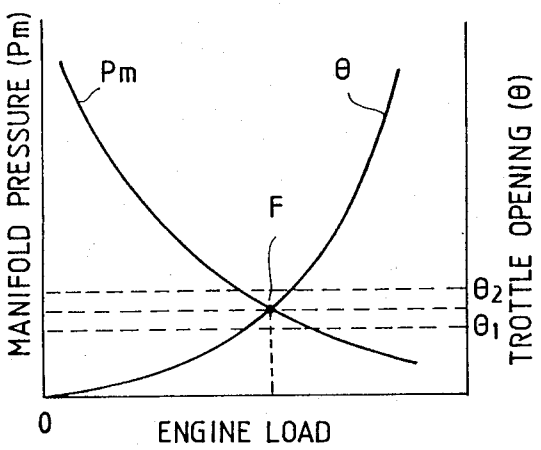
FIG. 1 is a graphic illustration of a typical example of engine operating characteristics adapted for use in the present invention.

Referring now to FIG. 1, the intake manifold pressure Pm and the throttle opening $\theta$ of an internal combustion engine in which the invention is adapted are illustrated graphically as a function of engine load with the engine speed N being kept constant. It is seen that as a function of engine load intake manifold pressure decreases substantially exponentially, while throttle opening increases but the rate of its increase also follows a substantially exponential curve.

According to the present invention, the intake manifold pressure is used as a predominant factor for air-fuel ratio control when the engine is operating under less loaded conditions and the throttle opening becomes the predominant factor instead of manifold pressure during the time the engine is under loaded conditions. By doing so it is possible to compensate for variations in air-fuel ratio that arise from variations in loading condition from idle to full loads. Since the rate of engine load variation is significant compared with those of other engine operating parameters, precision control of air-fuel ratio is made possible.

Figure 2:
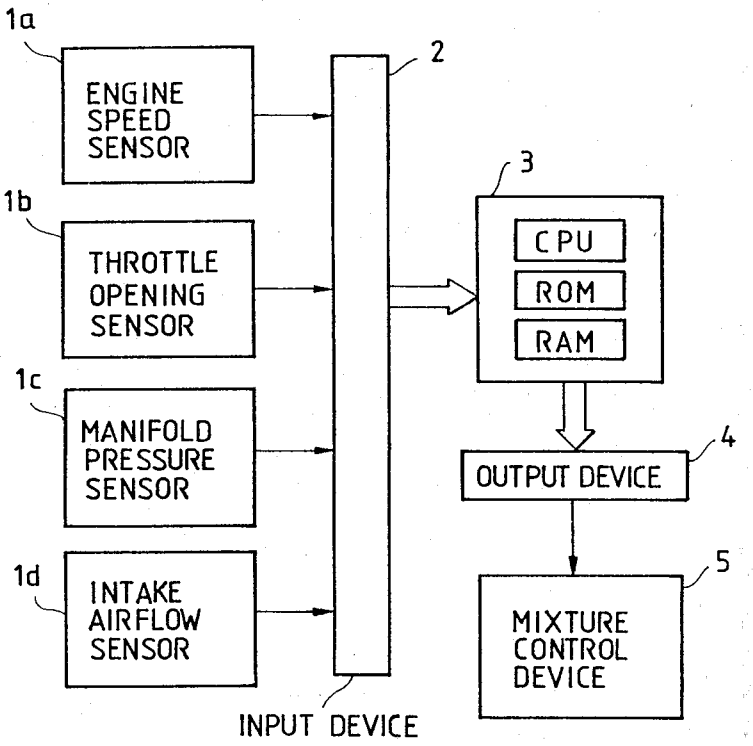
FIG. 2 is a schematic diagram of an engine control apparatus of the invention.

FIG. 2 is a schematic illustration of a hardware structure of the air-fuel mixture control system of the invention. The system comprises a plurality of engine parameter sensors including engine speed sensor 1*a*, throttle opening sensor 1*b* and manifold pressure sensor 1*c*. Via an input device 2 the signals from the sensors are fed to a microcomputer 3 which is programmed in a manner as will be described later. The computed data is applied through an output device 4 to an air-fuel mixture control device 5 of an internal combustion engine. The mixture control device may comprise a solenoid valve for carbureted engines or a fuel injector of any known type.

As will be detailed later, the microcomputer 3 compares a detected value of throttle opening with a reference value $\theta_1$ or $\theta_2$ which are below and above the intersection F of the two curves of FIG. 1, respectively. If the detected value is smaller than the reference value $\theta_1$, a detected value of manifold pressure is used as a control variable to determine the air-fuel ratio of mixture to be supplied to the engine. When the throttle opening becomes greater than the reference value $\theta_2$, the detected throttle opening takes over the manifold pressure. If the detected throttle opening falls between theses reference values a control variable is derived from both values of the detected manifold pressure and throttle opening by modifying them by a weighting factor that is a function of such values. It is to be noted that the manifold pressure or other suitable engine operating parameters could equally be as well used instead of the throttle opening as an indicator for switching the predominant control variable between the manifold pressure and throttle opening. Preferably, weighting factors are stored in memory for all possible values of sensed parameters and the microcomputer is programmed to execute weighting operations not only during such transitory conditions but also during other periods of execution by choosing an appropriate one from among the stored factors.

Figure 3:
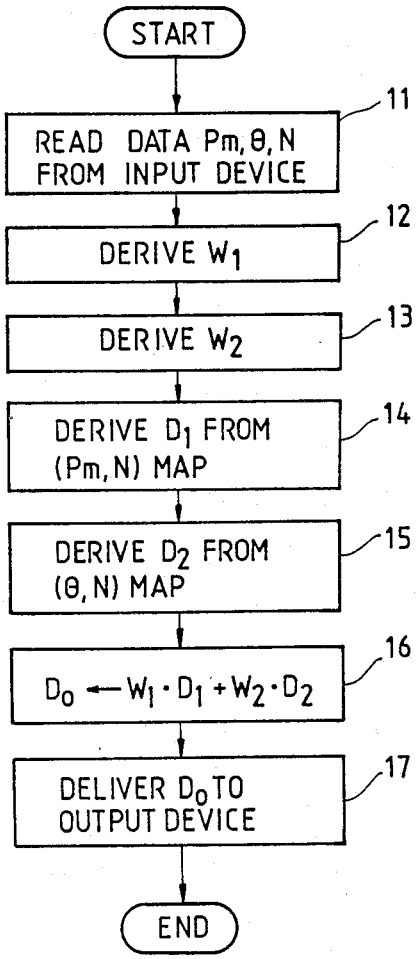
FIG. 3 is a flow chart describing a program of the microcomputer of FIG. 1.

FIG. 3 is an illustration of flowchart describing a typical example of the general procedure for deriving an air-fuel mixture control variable. In this exemplary procedure a first component $D_1$ of the control variable is derived from engine output operating parameters such as manifold pressure Pm and engine speed N and a second component $D_2$ of the variable from throttle opening $\theta$ and engine speed N. In block 11, the detected engine operating parameters Pm, $\theta$ and N are read from the input device 2 to the microcomputer 3. First and second weighting factors $W_1$ and $W_2$ are successively derived in blocks 12 and 13 preferably from control maps which are stored in a memory of the microcomputer. In each of the maps are stored an array of such weighting factors in such a manner that they are addressible in response to the detected engine operating parameters. Blocks 14 and 15 show steps in which the first component $D_1$ of the variable is derived from the values Pm and N of the detected manifold pressure (speed-density calculation) and engine speed which are stored in a control map of the memory to be addressed in response to the throttle opening as illustrated in FIG. 1. The second component $D_2$ is derived from the values $\theta$ and N of the detected throttle opening and engine speed (throttle-speed calculation) which are stored in another control map to be addressed in response to the throttle opening similar to that shown in FIG. 1. The derived control variables $D_1$ and $D_2$ are used in block 16 to be multiplied with the weighting factors $W_1$ and $W_2$ respectively and arithmetically added up to derive a control variable Do which is subsequently used in block 17 to control the air-fuel mixture.

Figure 4:
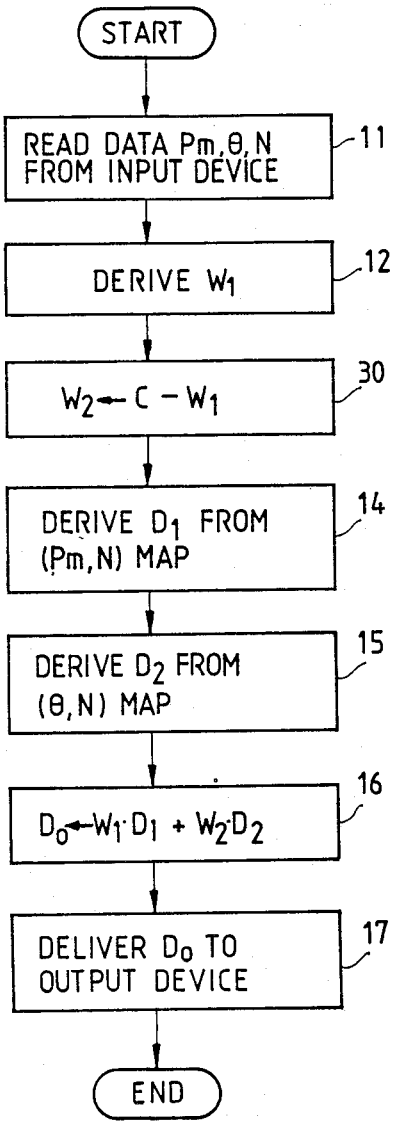
FIG. 4 is a flow chart describing a modified program of the microcomputer.

If it is desired that the weighting factors $W_1$ and $W_2$ be of complemenary values to each other so that the sum of $W_1$ and $W_2$ is a constant C, the flowchart of FIG. 3 is preferably modified as shown in FIG. 4. In block 30, the weighting factor $W_2$ is obtained by subtracting $W_1$ from the constant C.

Figure 5:
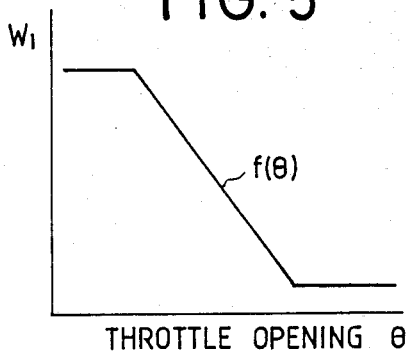
FIG. 5 is a graphic representation of a transfer function describing the relationship between a first weighting factor and throttle opening.

For smaller values of throttle opening a greater precision is obtained by speed-density calculation (Pm, N), and for larger values of throttle opening a greater precision is obtained by throttle-speed calculation ($\theta$, N). Therefore, it is preferable that the weighting factors $W_1$ and $W_2$ be expressed by the following formulas:

$$W_1 = F(\theta)$$

$$W_2 = C - W_1 = C - f(\theta)$$

where, $f(\theta)$ is a transfer function which describes the relationship between $W_1$ and throttle opening. As illustrated in FIG. 5, $W_1$ decreases linearly with throttle opening. This preferable feature is incorporated in a flowchart shown in FIG. 6 which is a modification of the flowchart of FIG. 4. The weighting factor $W_1$ is derived in block 20 from the transfer function $f(\theta)$. Therefore, the first term $W_1.D_1$, which is attributed to the speed-density factors (Pm, N), is a predominant factor when the engine is throttled to a small opening, and the second term $W_2.D_2$, which is attributed to the throttle-speed factors ($\theta$, N), becomes a predominant factor when the engine is wide-throttled.

Figure 7A:
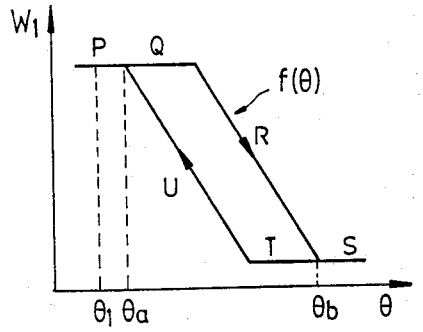
FIGS. 7A to 7C are graphic illustrations of a modified transfer function having hysteresis.

Under certain circumstances it is preferable that the transfer function $f(\theta)$ have a hysteresis loop as shown in FIG. 7A in such a manner that the weighting factor $W_1$ follows a downhill section P, Q, R, S when throttle opening is on the increase and follows an uphill section T, U, P when throttle opening is on the decrease. If it is desired that $W_1$ upwardly follow the downhill section when throttle opening starts decreasing before the point $\theta b$ is reached and that $W_1$ downwardly follow the uphill section when throttle opening starts increasing before the point $\theta a$ is reached.

Figure 6:
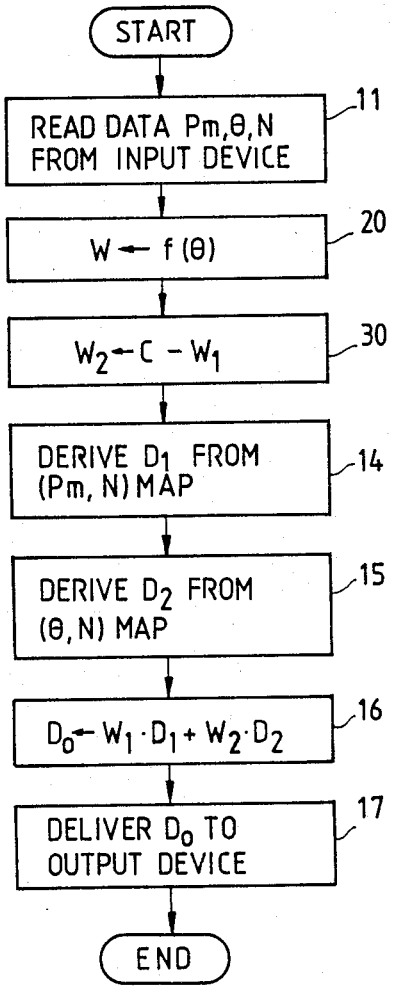
FIG. 6 is a flow chart describing a program incorporating the feature of FIG. 5.
Figure 7B:
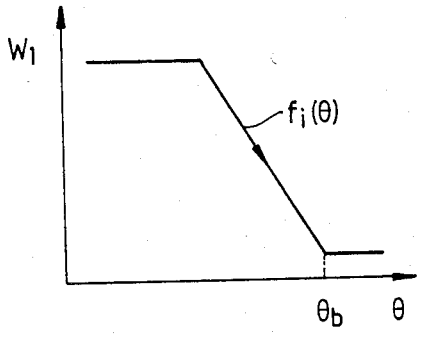
Figure 7C:
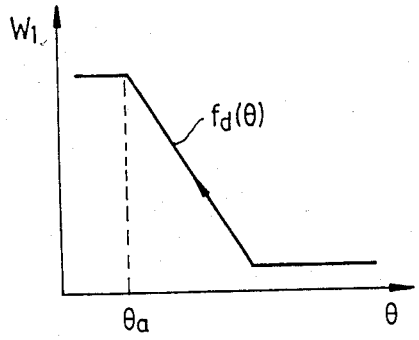
Figure 8:
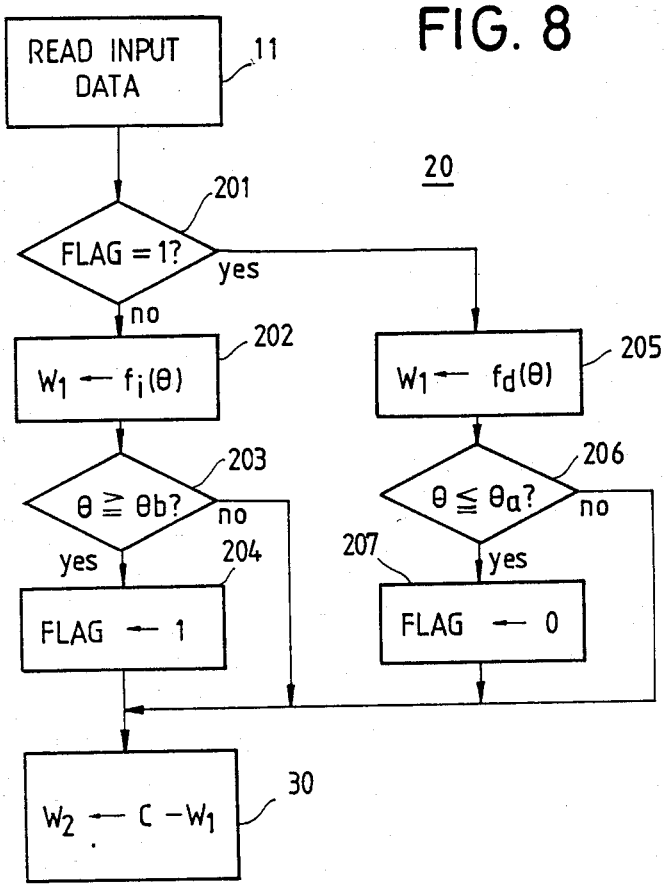
FIG. 8 is a flow chart describing a program incorporating the hysteresis characteristic.

This is accomplished by modifying the instruction in block 20 of FIG. 6 as shown in FIG. 8. When throttle opening is increasing in a range below $\theta b$, control follows blocks 201, 202 and 203 and exists to block 30 by checking if flag is set to "1" (in block 201), setting a transfer function $fi(\theta)$, FIG. 7B, to $W_1$ (in block 202) and checking the relative value of the throttle opening to $\theta b$ (in block 203). Once $\theta b$ is exceeded, control follows blocks 201, 202, 203 and 204 to set the flag to "1" (in block 204). If throttle opening subsequently decreases, blocks 201, 205 and 206 will be successively executed to be followed by block 30, whereby a transfer function fd($\theta$), FIG. 7C, is set to $W_1$ in block 205. If throttle opening is smaller than $\theta$a, the flag is set to "0" in block 207.

The embodiment of FIG. 6 is modified in a manner similar to that shown in FIG. 8 if it is desired that $W_1$ downwardly follow the uphill section if throttle opening starts increasing before the point $\theta$a is reached and upwardly follow the downhill section if throttle opening starts decreasing before the point $\theta$b is reached.

Figure 9:
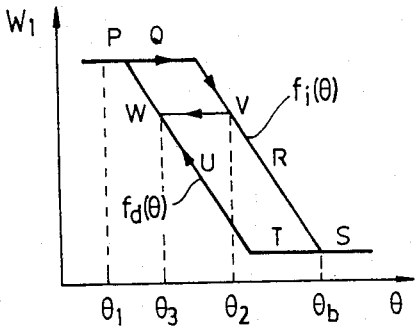
FIG. 9 is a graphic illustration of a modified hysteresis characteristic.

It may be desired that the weighting factor $W_1$ follow a loop section including points P, Q, V, W and P as shown in FIG. 9 when throttle opening starts decreasing before $\theta$b is reached. This is accomplished by modifying the step 20 of FIG. 6 as shown in FIG. 10.

Figure 10:
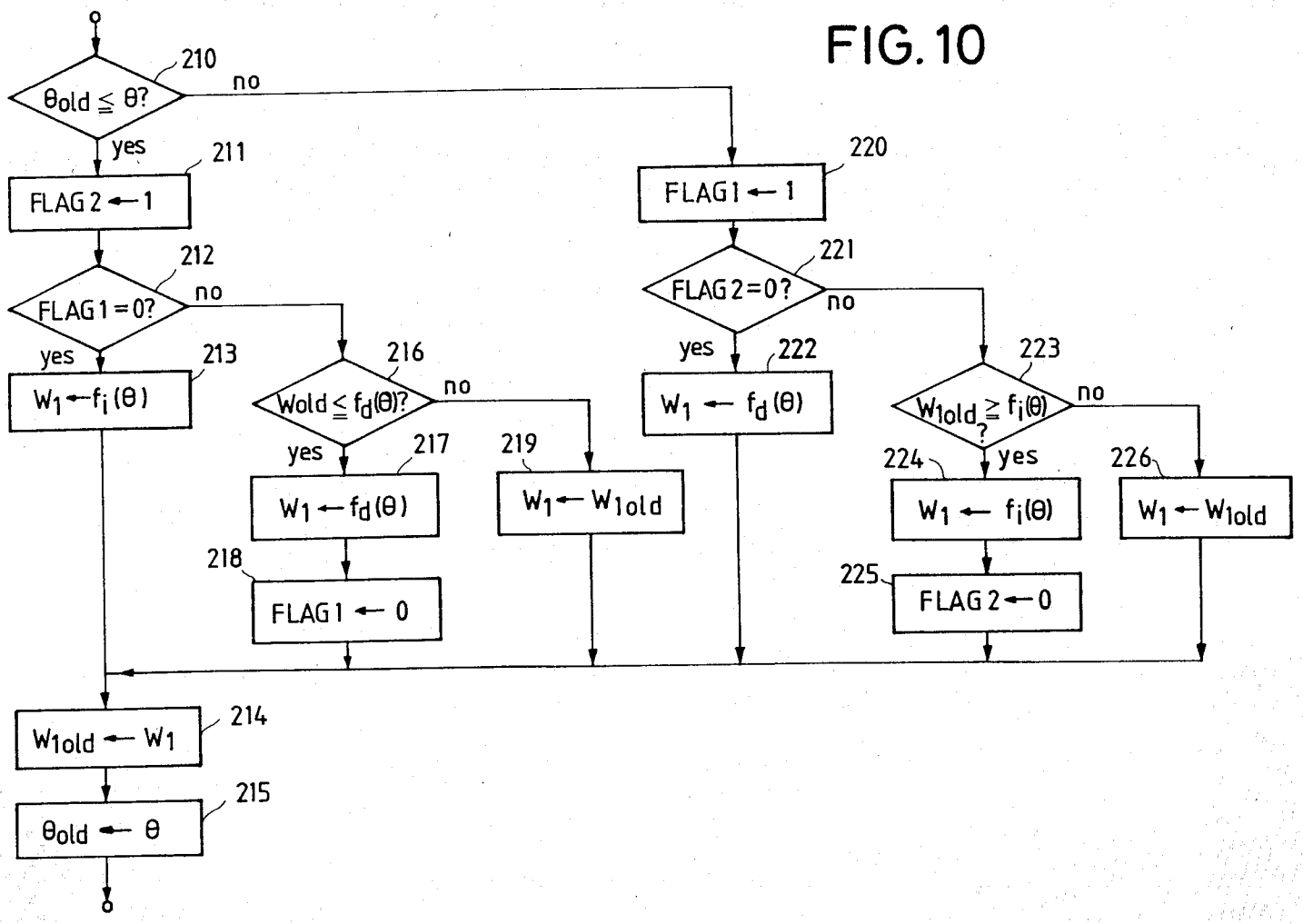
FIG. 10 is a flow chart describing a program associated with the modified hysteresis characteristic.

In FIG. 10, if throttle opening is smaller than the previous value, control exits from block 210 to block 211 to set "1" to flag 2 and goes to block 212 to check if flag 1 has been set to "0", and if so, it exits to block 213 to set fi($\theta$) to $W_1$. The current weighting factor $W_1$ is then stored in memory as an old value is block 214 and the current throttle opening is subsequently stored in memory as an old throttle opening value $\theta_{old}$ in block 215. If throttle opening is larger than the old value $\theta_{old}$, control will exit from block 210 to block 220 to set "1" to the flag 1. The latter block is followed by a block 221 in which it is checked whether flag 2 has been set to "0", and if so, control is routed to a block 222 to set transfer function fd($\theta$) to $W_1$.

Figure 11:
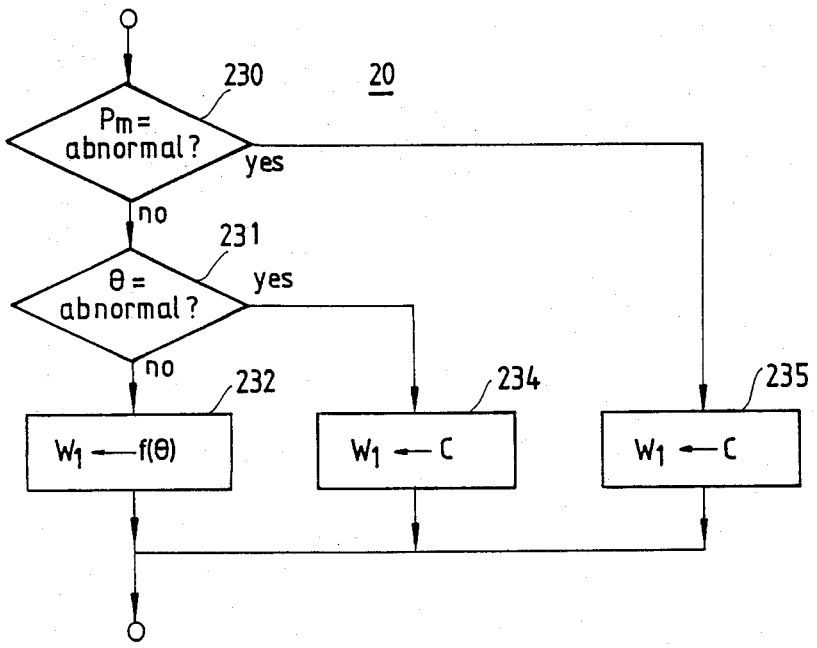
FIG. 11 is a modified flow chart of FIG. 6.

Under certain circumstances it is further desirable that different values of weighting factors be employed. For example, the pressure signal Pm is rendered invalid by an abnormal condition making the first control component $D_1$ ineffective, while the second control component $D_2$ remains effective. For this purpose, the subroutine 20 of FIG. 6 is modified as shown in FIG. 11. The abnormality of the pressure signal is determined in block 230 by checking whether it has exceeded predetermined limits, and if so, "0" is set to $W_1$ in block 235 and control exits to the next block 30 (FIG. 6). As a result, $W_2$ in block 30 is set equal to C and the ineffective $D_1$ is excluded from the calculation of Do in block 16. Similarly, the abnormality of the throttle signal is checked in block 231 and sets C to $W_1$ in block 234. Thus, $W_2$ is set equal to zero in block 30, so that Do is kept from being adversely affected by the failing throttle opening signal.

Figure 12:
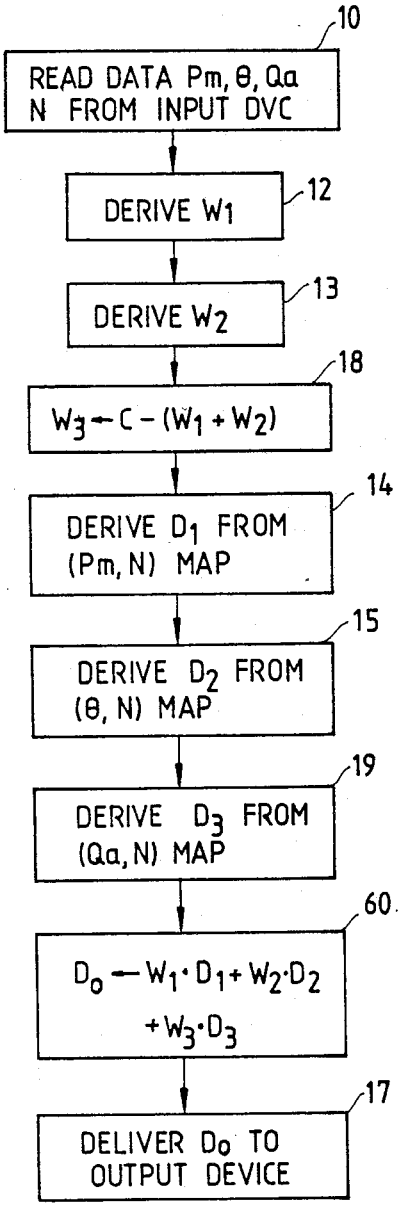
FIGS. 12–14 are flow charts of modified programs.

While mention has been made of manifold pressure and throttle opening as deciding parameters of $D_1$ and $D_2$, the intake air flow can also be used as one of the parameters. FIG. 12 is an illustration of the flow chart incorporating the intake air flow (Qa) as an additional parameter which is derived from an intake airflow sensor 1*d* shown in FIG. 1. In block 10, various input parameters including manifold pressure Pm, throttle opening $\theta$, intake airflow rate Qa and engine speed N, are read out of the input device 2. Weighting factors $W_1$ and $W_2$ are derived respectively in blocks 12 and 13 in a manner as explained in connection with FIG. 3. In block 18, a third weighting factor $W_3$ is derived by executing an equation $C-(W_1+W_2)$. $D_1$ and $D_2$ are derived in subsequent blocks 14 and 15 in a manner similar to that shown in FIG. 3. A third control component $D_3$ is derived in block 19 from the detected intake airflow rate Qa and engine speed N. In block 60, the control variable Do is obtained by executing an equation $W_1.D_1+W_2.D_2+W_3.D_3$.

Figure 13:
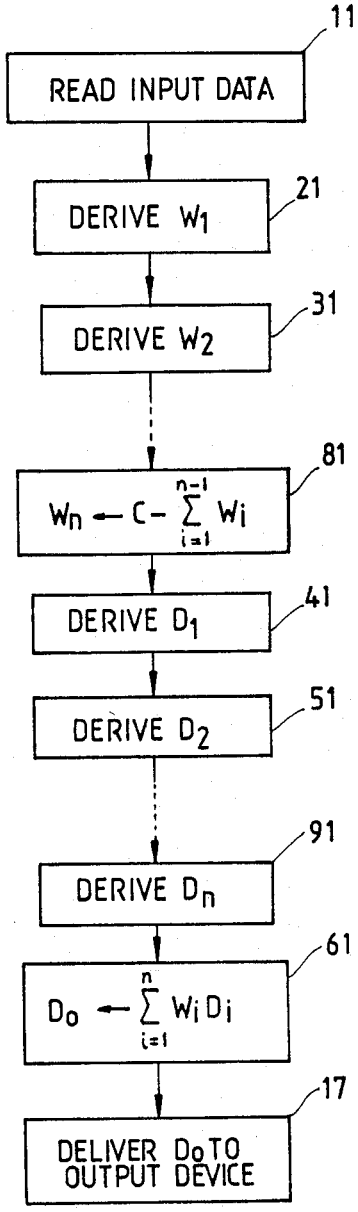

FIG. 13 shows a generalized process of deriving the control variable Do from a plurality of engine operating parameters. The weighting factors are represented by Wn and derived from an equation stated in block 81 and the control variable Do is derived by an equation stated in block 61.

Figure 14:
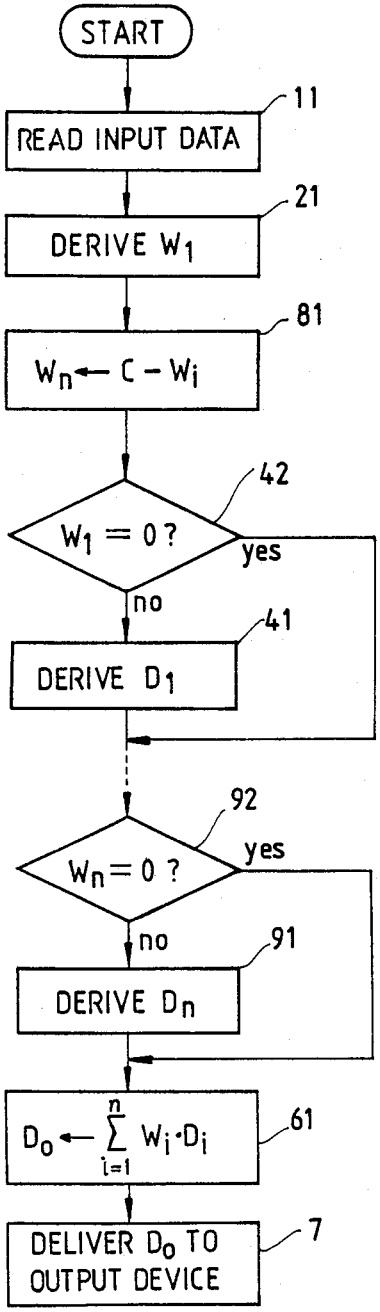

In the previous embodiments the flow charts have been depicted as comprising a continuous flow of instructions. FIG. 14 is a modified form of the process of FIG. 13 in which unnecessary steps are omitted for simplicity. In block 42, the weighting factor $W_1$ is checked whether it equals zero. If the weighting factor $W_1$ is set to zero in block 21 in a manner as described with reference to FIG. 11, control exits from block 42 to a block in which the weighting factor W2 will be derived bypassing the block 41 in which $D_1$ is determined. In like manner block 92 is provided to check for the presence of Wn=0 to skip the step 91 to exclude Dn if Wn=0 has been set in block 81.

What is claimed is:

1. An apparatus for controlling an internal combustion engine having a plurality of input operating parameters, comprising:

a plurality of sensors for detecting first, second and third output operating parameters of said engine; and a microcomputer having at least first and second control maps in which first and second control variables are arranged respectively, said first and second control variables being addressible in response to different combinations of said detected output operating parameters, said microcomputer being programmed to execute the following steps:

(a) deriving first and second weighting factors;

(b) addressing said first control map to derive a said first control variable in response to the detected first and second output operating parameters;

(c) addressing said second control map to derive a said second control variable in response to the detected second and third output operating parameters;

(d) multiplying said first and second control variables by said first and second weighting factors, respectively; and (e) summing said multiplied first and second control variables to derive a combined control variable for controlling one of said input operating parameters.

2. An apparatus as claimed in claim 1, wherein said first, second and third output operating parameters are the intake manifold pressure, the speed of revolution and the throttle opening of said engine, respectively, and wherein one of said output operating parameters is used in at least one of the steps (b) and (c) to determine either of said manifold pressure and throttle opening as a predominant determining factor for addressing said first and second control variables.

3. An apparatus as claimed in claim 1, wherein one of said weighting factors is variable as a function of one of said detected output operating parameters.

4. An apparatus as claimed in claim 1, wherein the step (a) comprises the steps of detecting when said first output operating parameter is abnormal, setting said first weighting factor to zero, and detecting when said second output operating parameter is abnormal and setting said second weighting factor to a predetermined constant value.

5. An apparatus as claimed in claim 1, wherein said one weighting factor is derived from a map addressible in response to said one detected operating parameter, there being a transfer function describing the relationship between said one weighting factor and said one detected operating parameter.

6. An apparatus as claimed in claim 5, wherein said transfer function has a hysteresis characteristic.

7. An apparatus as claimed in claim 6, wherein said transfer function of hysteresis characteristic comprises a first slope section and a second slope section, said one weighting factor being variable following each of said first and second slope sections in opposite directions.

8. An apparatus as claimed in claim 7, wherein said one weighting factor is derived from a map addressible in response to said one detected operating parameter, there being a transfer function describing the relationship between said one weighting factor and said one detected operating parameter.

9. A method for controlling an internal combustion engine having a plurality of input operating parameters and a plurality of output operating parameters, comprising the steps of:

(a) providing at least first and second control maps in which first and second control variables are arranged respectively, said first and second control variables being addressible in response to different combinations of said output parameters;

(b) detecting first, second and third output operating parameters of said engine;

(c) deriving first and second weighting factors;

(d) addressing said first control map to derive a said first control variable in response to the detected first and second output operating parameters;

(e) addressing said second control map to derive a said second control variable in response to the detected second and third output operating parameters;

(f) multiplying said first and second control variables by said first and second weighting factors, respectively; and (g) summing said multiplied first and second control variables to derive a combined control variable for controlling one of said input operating parameters.

10. A method as claimed in claim 9, wherein said first and second weighting factors are complementary to each other.

11. A method as claimed in claim 9, wherein said first, second and third output operating parameters are the intake manifold pressure, the speed of revolution and the throttle opening of said engine, respectively, and wherein one of said output operating parameters is used in at least one of the steps (d) and (e) to determine either of said manifold pressure and throttle opening as a predominant determining factor for addressing said first and second control variables.

12. A method as claimed in claim 9, wherein the step (c) comprises the steps of detecting when said first output operating parameter is abnormal, setting said first weighting factor to zero, detecting when said second output operating parameter is abnormal and setting said second weighting factor to a predetermined constant value.

13. A method as claimed in claim 9, wherein one of said weighting factors is variable as a function of one of said detected output operating parameters.

14. A method as claimed in claim 13, wherein said one weighting factor is derived from a map addressible in response to said one detected operating parameter, there being a transfer function describing the relationship between said one weighting factor and said one detected operating parameter.

15. A method as claimed in claim 9, wherein said one weighting factor is derived from a map addressible in response to said one detected operating parameter, there being a transfer function describing the relationship between said one weighting factor and said one detected operating parameter.

16. A method as claimed in claim 15, wherein said transfer function has a hysteresis characteristic.

17. A method as claimed in claim 16, wherein said transfer function of hysteresis characteristic comprises a first slope section and a second slope section, said one weighting factor being variable following each of said first and second slope sections in opposite directions.

* * * * *